United States Patent [19]

Muramatsu et al.

[11] Patent Number: 4,836,713

[45] Date of Patent: Jun. 6, 1989

[54] FLEXIBLE SHEET DAMS

[75] Inventors: Tateo Muramatsu, Yokohama; Hideaki Saito, Chigasaki; Mamoru Takasaki, Tokyo; Yasushi Enami, Yokohama, all of Japan

[73] Assignee: Bridgestone Corporation, Tokyo, Japan

[21] Appl. No.: 918,441

[22] Filed: Oct. 14, 1986

[30] Foreign Application Priority Data

| | | | |
|---|---|---|---|
| Oct. 12, 1985 | [JP] | Japan | 60-225991 |
| Jan. 14, 1986 | [JP] | Japan | 61-4387 |
| Jan. 30, 1986 | [JP] | Japan | 61-16905 |

[51] Int. Cl.[4] ..... E02B 7/04

[52] U.S. Cl. ..... 405/115; 405/91

[58] Field of Search ..... 405/87, 91, 107, 110, 405/111, 115; 252/17, 25, 31

[56] References Cited

U.S. PATENT DOCUMENTS

| | | | |
|---|---|---|---|
| 495,788 | 4/1893 | Debarle | 405/115 |
| 2,609,666 | 9/1952 | Mesnager | 405/115 |
| 4,167,358 | 9/1979 | Besha | 405/87 |
| 4,243,434 | 1/1981 | Hartley et al. | 252/31 |
| 4,279,540 | 7/1981 | Suga et al. | 405/115 |
| 4,299,514 | 11/1981 | Muramatsu et al. | 405/115 |
| 4,352,591 | 10/1982 | Thompson | 405/115 X |
| 4,557,839 | 12/1985 | Tubbs et al. | 252/25 |
| 4,661,015 | 4/1987 | Tsuji et al. | 405/115 |
| 4,662,783 | 5/1987 | Muramatsu et al. | 405/115 |
| 4,696,598 | 9/1987 | Tsuji et al. | 405/115 |

FOREIGN PATENT DOCUMENTS

| | | | |
|---|---|---|---|
| 649778 | 5/1979 | U.S.S.R. | 405/115 |
| 967354 | 8/1964 | United Kingdom . | |
| 2035427 | 6/1980 | United Kingdom . | |
| 2077825 | 12/1981 | United Kingdom . | |
| 2088935 | 6/1982 | United Kingdom . | |

*Primary Examiner*—Randolph A. Reese
*Assistant Examiner*—John Ricci
*Attorney, Agent, or Firm*—Sughrue, Mion, Zinn, Macpeak & Seas

[57] ABSTRACT

A flexible sheet dam is secured to the riverbed along two securing lines at upstream and downstream sides. In this dam, at least one concave and/or convex region is made in the plane of the riverbed between the two securing lines in a direction parallel to the securing lines, whereby the complete deflation of the dam can be attained without trouble.

13 Claims, 14 Drawing Sheets

FLEXIBLE SHEET DAMS

BACKGROUND OF THE INVENTION

1. Field of the Invention

This invention relates to a collapsible, flexible sheet dam laid in a river thereacross inflated and deflated through the supply and discharge of air, and more particularly to a collapsible, flexible sheet dam laid in a place having a certain water level at a downstream side.

2. Related Art Statement

Generally, flexible sheet dams known as a collapsible rubber dam are simple to work and cheap in manufacturing cost, so that they are widely used as an intake dam for irrigation water, a barrier for damming seawater near a mouth of a river or the like.

In such a flexible sheet dam, a continuous flexible sheet (made from rubber or flexible resin) is, for example, folded into two parts and both longitudinal free edges thereof are aligned to each other, and then the aligned edge portion is directed toward an upstream side of a river and straightly secured to a riverbed face through a keep member extending in the widthwise direction of the river to form a closed bag-shaped body. Alternatively, the flexible sheet dam of the above construction is further secured to the riverbed face at a position separated downstream from the secured position of the aligned edge portion at an adequate interval through a keep member arranged inside the bag-shaped body and straightly extending in parallel to the secured line of the edge portion.

The latter flexible sheet dam secured at two positions of upstream and downstream sides (hereinafter referred to as a double securing-type dam) is particularly used in a place having a certain water level at the downstream side. In the double securing-type dam, when deflation is carried out by discharging air filled in the interior of the dam, there are problems to be discussed herein.

FIGS. 1*a* to 1*c* are sectional side elevations illustrating the deflection process of a double securing-type flexible sheet dam 02 laid on a concrete foundation 01 of a riverbed, respectively. As shown in FIG. 1*a*, the flexible sheet dam 02 is constructed by securing to the concrete foundation 01 at upstream securing line A and downstream securing line B. Further, spacer pipes 03 for the supply and discharge of air are fixed to a portion of the flexible sheet extending between the securing lines A and B (or a portion of the concrete foundation 01 inside the flexible sheet dam 02) at a certain interval, and plural spacers S are fixed to an inner surface portion of the folded flexible sheet facing the upstream side of the river at given intervals in the longitudinal direction of the flexible sheet dam 02.

When the air is discharged from the interior of the flowable sheet dam of the above construction, the deflation state of such a dam is different from that of a water-filling type flexible dam as mentioned below. At an initial deflation stage as shown in FIG. 1*b*, portions of the flexible sheet located above the securing lines A and B are gently deformed inward curvedly by the air discharge and the water pressure of the river to form curved portions 05 and 06, respectively. As the discharge of the air further proceeds, the curved portions 05 and 06 formed in the flexible sheet dam 02 are press-contacted with each other, and finally made into a joint palm state, whereby the damming function is lost to make ready for deflation.

Even when the flexible sheet dam 02 is in the deflatable state by the discharge of air, as shown in FIG. 1*c*, air spaces are formed in the interior of the dam at a joint point side D defined by joining end portions of two sheets to each other, a top site E of the dam after the formation of joint palm state, and gaps between the spacers S fixed to the inner face of the dam in addition to a lower space C defined by the sheet and spacer pipes 03, so that the filled air still remains in these air spaces in the longitudinal direction of the dam 02. As a result, buoyancy based on the remaining air in the air spaces exceeds the weight in water of the flexible sheet dam 02, so that it is difficult to forcedly deflate the dam 02. Therefore, the dam 02 is floating in water, which undesirably obstructs vessels such as fishing boat, working boat and the like using the river.

SUMMARY OF THE INVENTION

It is, therefore, an object of the invention to provide a novel double securing-type flexible sheet dam overcoming the aforementioned problems.

According to the invention, there is the provision of a collapsible, flexible sheet dam extending transversely of a river and secured to a riverbed at two securing lines, one of which being located on the upstream side of the river and the other of which being located on a position separated from the upstream side toward the downstream side at a given interval, characterized in that a region extending between said two securing lines is made into at least one large concave and/or convex form extending in a direction parallel to the securing line.

In a preferred embodiment of the invention, a means for reducing contact friction between the concave or convex region and the flexible sheet is provided on the surface of the concave or convex region.

In another preferred embodiment of the invention, a means for housing a part of the flexible sheet is formed in the concave or convex region.

BRIEF DESCRIPTION OF THE DRAWINGS

The invention will be described with reference to the accompanying drawings, wherein.

DESCRIPTION OF THE PREFERRED EMBODIMENTS

Figure 1A:
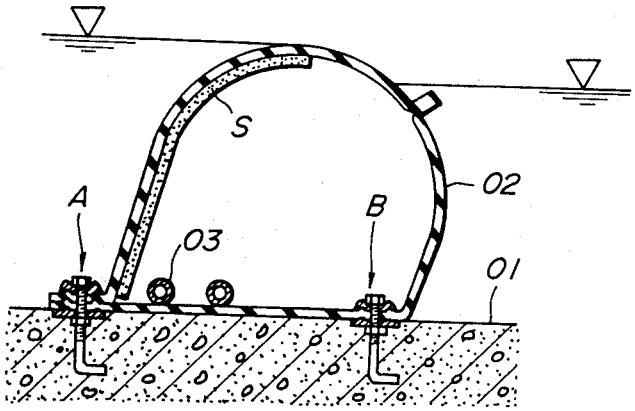
FIG 1a PRIOR ART
FIGS. 1*a* to 1*c* are sectional side elevations illustrating the change of inflation state of the conventional flexible dam into deflation state, respectively.
Figure 1B:
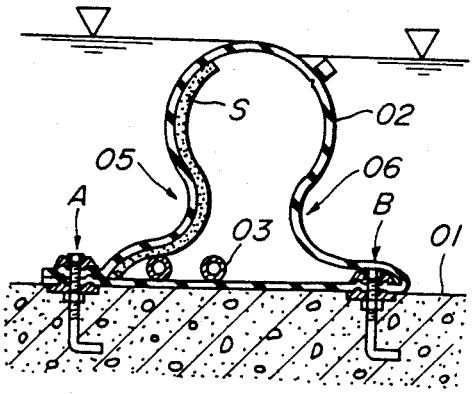
FIG 1b PRIOR ART
Figure 1C:
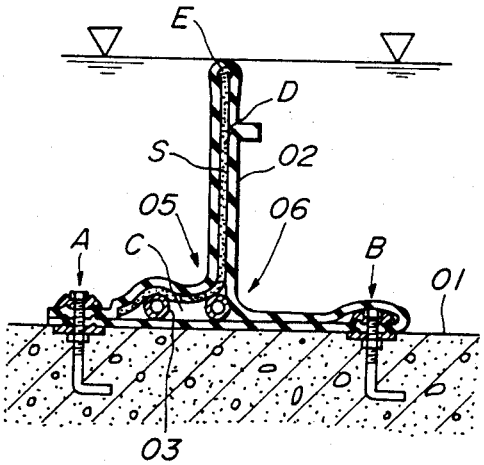
FIG 1c PRIOR ART

In FIGS. *2a* to *2c* is shown a deflation process of a first embodiment of the double securing-type flexible sheet dam according to the invention. As shown in FIG. *2a*, a concrete foundation 2 is formed in a riverbed for laying a flexible sheet dam 4. The dam 4 is constructed by aligning both side edges of a folded flexible sheet 6 (made from rubber, flexible resin or the like) to each other, placing the aligned edge portion on the concrete foundation 2 at an upstream side of a river, and securing this edge portion to the concrete foundation 2 at a securing line A while securing a portion of the lower sheet body at a securing line B separated from the securing line A toward the downstream side at a given interval. Thus, the flexible sheet dam 4 is laid on the concrete foundation 2 so as to inflate and deflate through the supply and discharge of air. In this case, two convex portions 8 each having a semi-circular form in section are formed on the surface of the concrete foundation 2 between the two securing lines A and B so as to extend in a direction parallel to the securing line at given intervals separated from the securing line A.

FIG. *2a* shows the inflation state of the flexible sheet dam 4 by supplying air into an inner chamber defined by folding the flexible sheet 6 and securing the folded sheet at the two securing lines as mentioned above. In this case, the lower folded sheet portion extends at a region between the two securing lines A and B so as to cover the flat portion and convex portion of the concrete foundation 2.

Further, plural spacers S are attached at the upstream side to the inner wall surface of the upper folded sheet body 6 over substantially a semicircle of the dam 4 at given intervals separated in the longitudinal direction of the dam. When the flexible sheet dam 4 is deflated by the discharge of air, the spacers serve to form an air passage between the spacers in the inner chamber of the dam 4.

Moreover, the flexible sheet dam 4 is provided at a lower corner of the inner chamber near the upstream side with pipes 10 for supplying air to the inner chamber and discharging therefrom.

FIG. *2b* shows an initial deflation state of the flexible sheet dam. When the deflation of the inflated dam 4 as shown in FIG. *2a* is started by the discharge of air, portions of the flexible sheet 6 above the securing lines A and B are substantially symmetrically deformed inward by the water pressures of the upstream and downstream and the reduction of internal air pressure to form curved portions 12, 14 in the floating flexible sheet. As the discharge of air from the inner chamber of the dam 4 proceeds further, the dam is deflated to finally contact the curved portions 12, 14 with each other at a substantially middle point between the two convex portions 8 while closely contacting with the surface of the lower sheet body extending between the securing lines A and B as shown in FIG. *2c*. Since the length of the concrete foundation surface between the securing lines A and B including the two convex portions A and B is longer than that including no convex portion, the length of the floating flexible sheet body contacting with the lower sheet body located between the securing lines A and B at the deflation state becomes also longer as compared with the case including no convex portion, and consequently the extra length of the flexible sheet portion floating above the contact point between the curved portions is very small. Therefore, the flexible sheet dam 4 can be changed from the inflation state as shown in FIG. *2a* into the substantially complete deflation state as shown in FIG. *2c* through the discharge of air.

In FIGS. *3a* to *3c* is shown a deflation process of a second embodiment of the double securing-type flexible sheet dam according to the invention. This embodiment is different from the first embodiment in a point that a concave portion 20 is formed in the concrete foundation 2 and the securing line B is located on a part of the concave portion 20.

The flexible sheet dam 4 is deflated from an inflation state as shown in FIG. *3a* through an initial deflation state as shown in FIG. *3b* to a complete deflation state as shown in FIG. *3c* by the discharge of air. Since the distance between the securing lines A and B including the concave portion 20 is longer than that including no concave portion, the floating portion of the flexible sheet 6 can easily be fallen into the concave portion 20 to locate the contact point between the curved portions 12 and 14 on a middle position of the concave portion 20 at such a state that only a slight floating portion of the flexible sheet extends above the contact point between the curved portions 12 and 14. That is, the substantially complete deflation state can be attained even in the second embodiment.

Figure 2A:
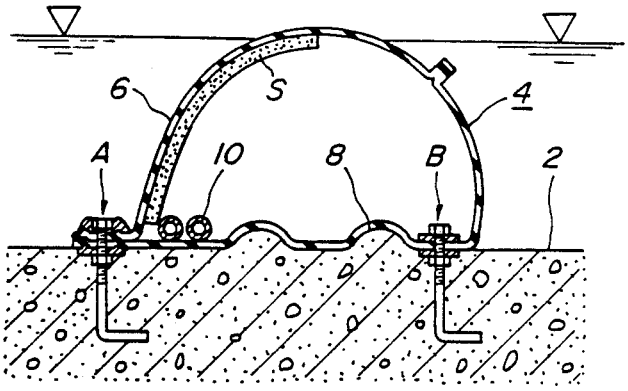
FIGS. 2*a* to 2*c* are sectional side elevations illustrating deflation process of a first embodiment of the flexible sheet dam according to the invention, respectively.
Figure 2B:
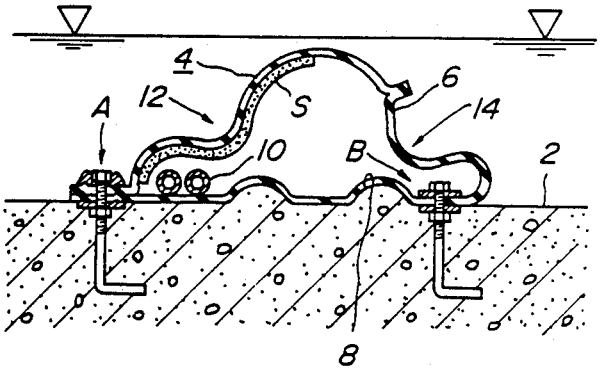
Figure 2C:
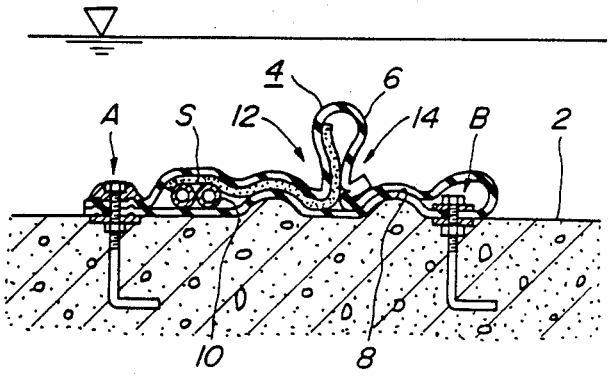
Figure 3A:
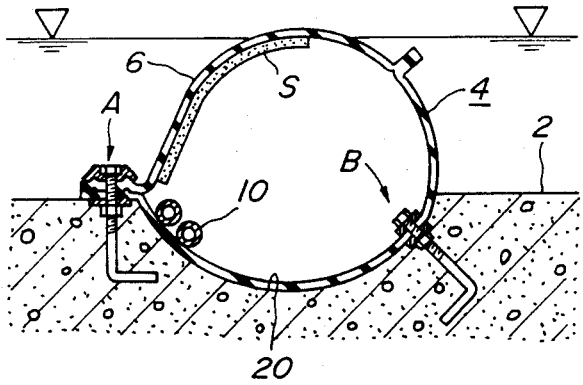
FIGS. 3*a* to 3*c* are sectional side elevations illustrating deflation process of a second embodiment of the flexible sheet dam according to the invention, respectively.
Figure 3B:
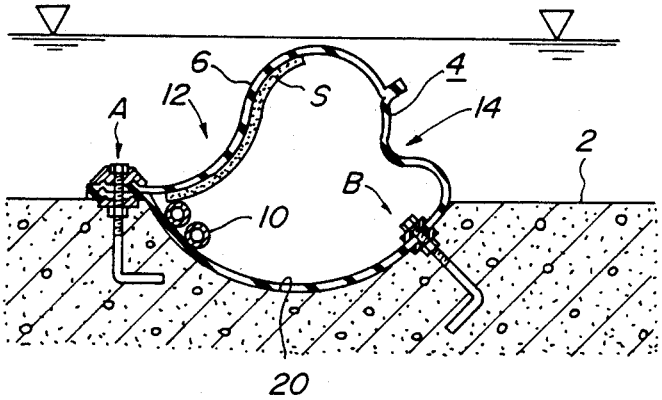
Figure 3C:
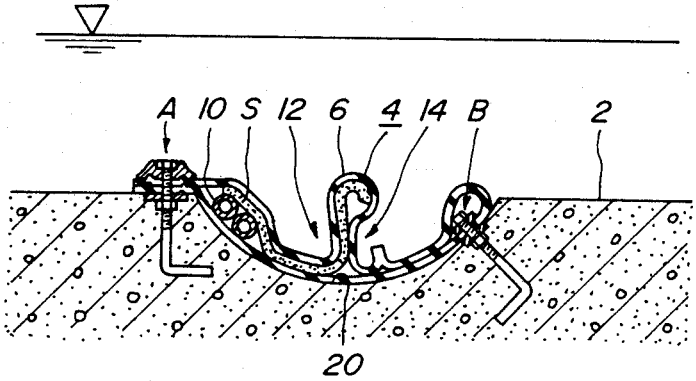

FIGS. *4a* to *4c* show a deflation process of a third embodiment, wherein the region ranging between the securing lines A and B is made from a combination of the first embodiment of FIG. 2 with the second embodiment of FIG. 3. That is, the concave portion 20 is formed in the concrete foundation 2 of the riverbed and two convex portions 22 each having a semicircle in section are formed on the concave portion 20 between the securing lines A and B at a given interval so as to extend in a direction parallel to the securing line.

The inflated flexible sheet dam 4 as shown in FIG. *4a* is deflated through an initial deflation state as shown in FIG. *4b* into a substantially complete deflation state as shown in FIG. *4c* by the discharge of air. The floating portion of the flexible sheet 6 can easily be fallen down into the concave portion 20 to leave a slight part of the floating flexible sheet above the contact point between the curved portions 12 and 14, because the length of the riverbed between the securing lines A and B including the concave portion 20 and convex portions 22 are fairly longer than that including no concave and convex portions.

Figure 4A:
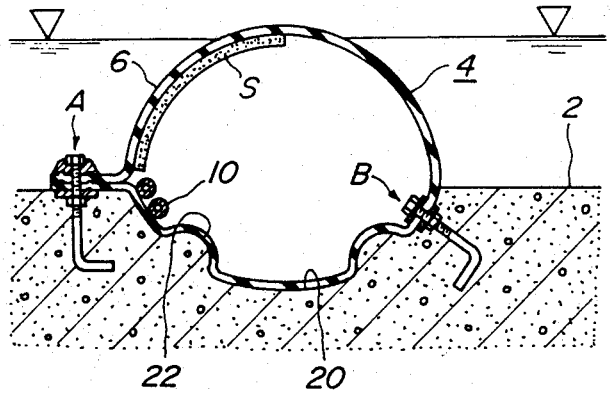
FIGS. 4*a* to 4*c* are sectional side elevations illustrating deflation process of a third embodiment of the flexible sheet dam according to the invention, respectively.
Figure 4B:
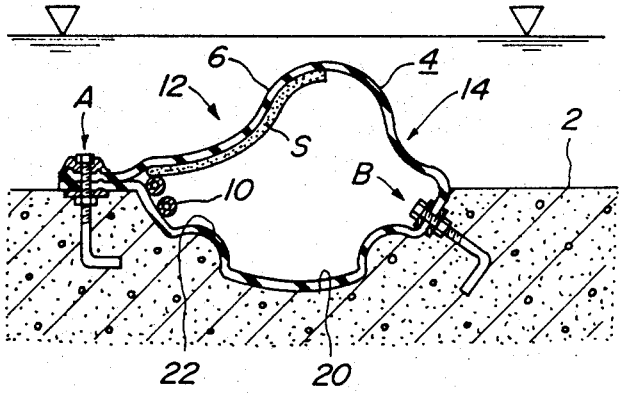
Figure 4C:
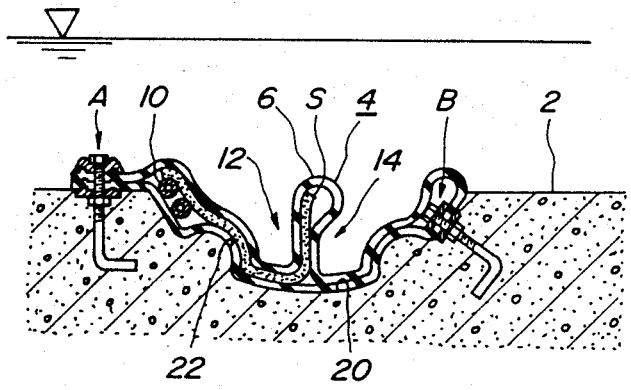

In the embodiments of FIGS. 3 and 4, the top position of the flexible sheet located above the contact point between the curved portions at the deflation state can be further lowered by properly adjusting the depth of the concave portion formed between the two securing lines.

Figure 5A:
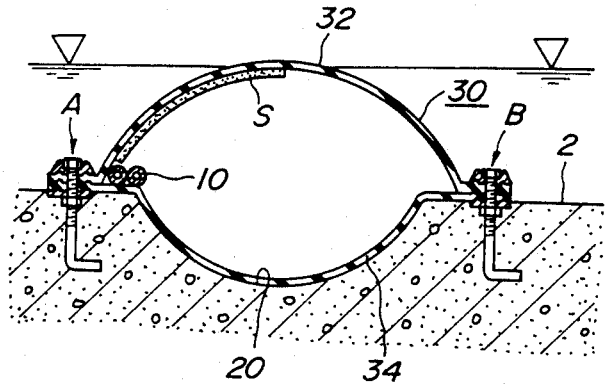
FIGS. 5*a* and 5*b* are sectional side elevations showing inflation and deflation states of a fourth embodiment of the flexible sheet dam according to the invention, respectively.
Figure 5B:
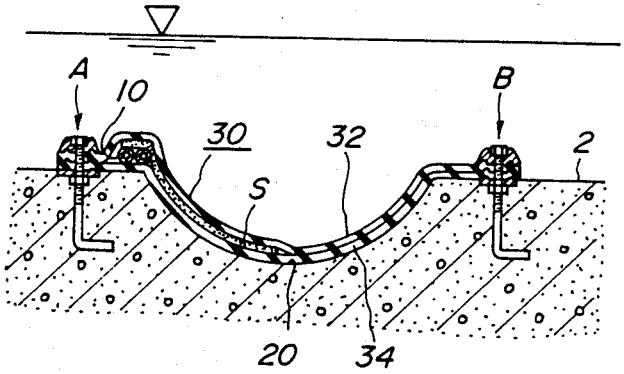

FIGS. 5*a* and 5*b* show the inflation and deflation states of a fourth embodiment of the flexible sheet dam according to the invention. In this embodiment, two flexible sheets 32 and 34 having the same width are secured at their free ends to the riverbed at two securing lines A and B, and the concave portion 20 is formed in the concrete foundation 2 of the riverbed between the securing lines A and B.

The flexible sheet dam 30 of the above construction is changed from an inflation state as shown in FIG. 5*a* to a complete deflation state as shown in FIG. 5*b* by the discharge of the filled air. The upper flexible sheet 32 is completely fallen down in the concave portion 20 along the upper surface of the lower flexible sheet 34 because the length of the concave portion 20 is the same as the width of the flexible sheet 32.

Figure 6A:
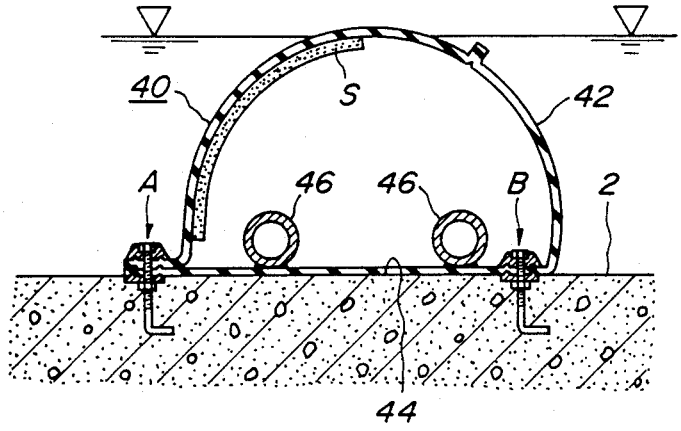
FIGS. 6*a* and 6*b* are sectional side elevations showing inflation and deflation states of a fifth embodiment of the flexible sheet dam according to the invention, respectively.
Figure 6B:
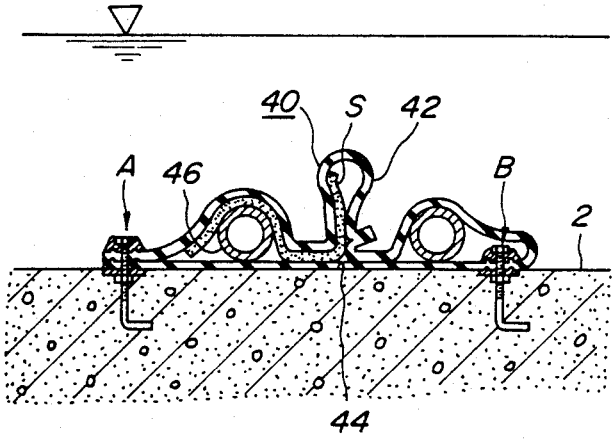

In FIGS. 6*a* and 6*b* is shown a fifth embodiment of the double securing-type flexible sheet dam according to the invention, which is a modified embodiment of FIG. 2. That is, a lower portion of a flexible sheet 42 provided with a split portion at a predetermined position in thickness direction and extending along lengthwise direction is placed on a horizontal surface 44 of the concrete foundation 2 of the riverbed and secured to the concrete foundation 2 along two securing lines A and B separated at a given interval, whereby a flexible sheet dam 40 having an inflation state as shown in FIG. 6*a* is formed. Further, two structural members 46 (made from iron or rigid synthetic resin) such as pipes having a circular section and a diameter larger than that of the pipe 10 of FIG. 2 are placed on the lower portion of the flexible sheet 42 between the securing lines A and B at a given interval in a direction parallel to the securing line and fixed to the lower portion through an adhesive. Such a structural member 46 has the same function as in the convex portion 8 of FIG. 2. In this case, therefore, the complete deflation of the flexible sheet dam can easily be achieved as in the case of FIG. 2.

Figure 7:
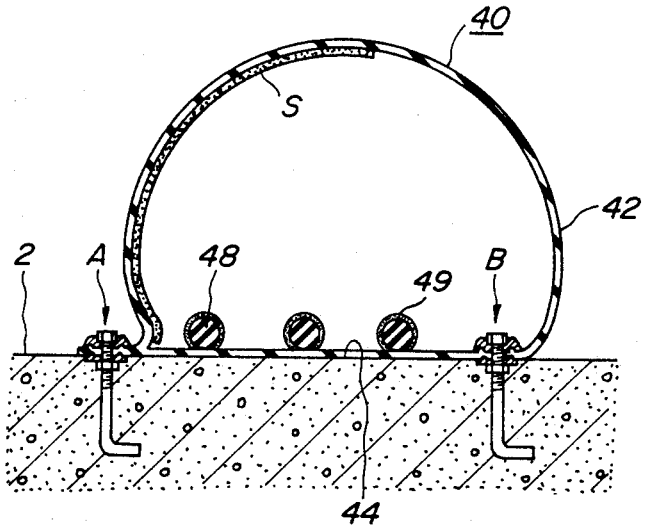
FIGS. 7 and 8 are sectional side elevations of a sixth embodiment of the flexible sheet dam according to the invention, respectively.

FIG. 7 illustrates an inflation state of a sixth embodiment of the flexible sheet dam according to the invention, which is a modified embodiment of FIG. 6. That is, plural rod members 48 (three rods in this embodiment) are arranged between the two securing lines A and B on the surface of the lower portion of the flexible sheet 42 laid on the horizontal plane 44 of the concrete foundation 2 in a direction parallel to the securing line as a structural member instead of the pipe shown in FIG. 6. Each of these rod members 48 is locally attached to the surface of the lower sheet portion through a band of an elastomeric material such as rubber or the like (not shown) so as to freely move in a direction perpendicular to the longitudinal direction of the axial center of the rod member 48 utilizing the elasticity of the band.

In the embodiment of FIG. 7, therefore, a convex portion is formed on the surface of the lower sheet portion laid on the concrete foundation 2 between the securing lines A and B by each of the rod members 48 attached through the bands, while a concave portion for receiving a part of the upper sheet portion at the deflation state is formed between the rod members 48.

Further, molybdenum disulfide or the like 49 is applied to the surface of the rod member 48 to form a lubrication layer for facilitating the movement of the upper sheet portion deflated on the rod member (not shown). Moreover, a hollow tube may be used instead of the rod member.

Figure 8:
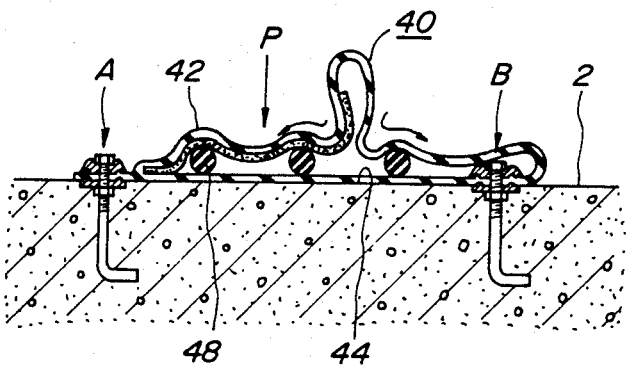

When the flexible sheet dam 40 is changed from the inflation state shown in FIG. 7 into a deflation state shown in FIG. 8 by the discharge of air, the upper portion of the flexible sheet 42 is first contacted with the rod members 48 while forming the curved portions through the discharge of air and a water pressure P. Then, a portion of the upper sheet portion is pushed toward the concave portion defined between the rod members 48 by the action of water pressure P, while the smooth movement of the upper sheet portion is allowed in a direction shown by an arrow in FIG. 8 without causing contact friction between the deflated upper sheet portion and the rod member because molybdenum disulfide or the like is applied as a lubrication layer to the surface of the rod member, whereby the flexible sheet dam 40 can completely be deflated without leaving the floating portion of the flexible sheet. If the upper sheet portion is insufficiently pushed into the concave portion between the rod members, since the rod member is locally attached to the lower sheet portion through the band to freely move in the direction perpendicular to the longitudinal direction of the rod member utilizing the elasticity of the band, the complete deflation of the upper sheet portion can easily be achieved without the movement of the rod member.

Figure 9:
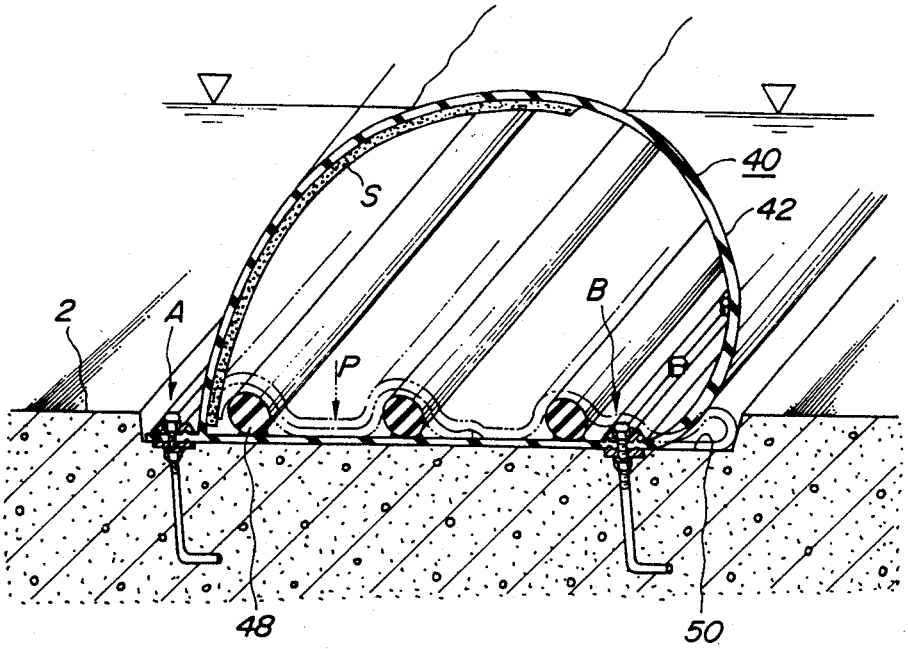
FIGS. 9 and 10 are perspective views of seventh and eighth embodiments of the flexible sheet dam according to the invention, respectively.

FIG. 9 is a seventh embodiment of the flexible sheet dam being a modified embodiment of FIGS. 7 and 8. In the concrete foundation 2 is formed a groove 50 having a width enough to admit a width of the completely deflated flexible sheet dam 40 shown by a phantom line in FIG. 9 and a given depth across the river. The bottom surface of the groove 50 is parallel to the upper surface of the concrete foundation 2. In the embodiment of FIG. 9, therefore, water can be run more smoothly from the upstream side toward the downstream side in the deflation of the flexible sheet dam 40.

Figure 10:
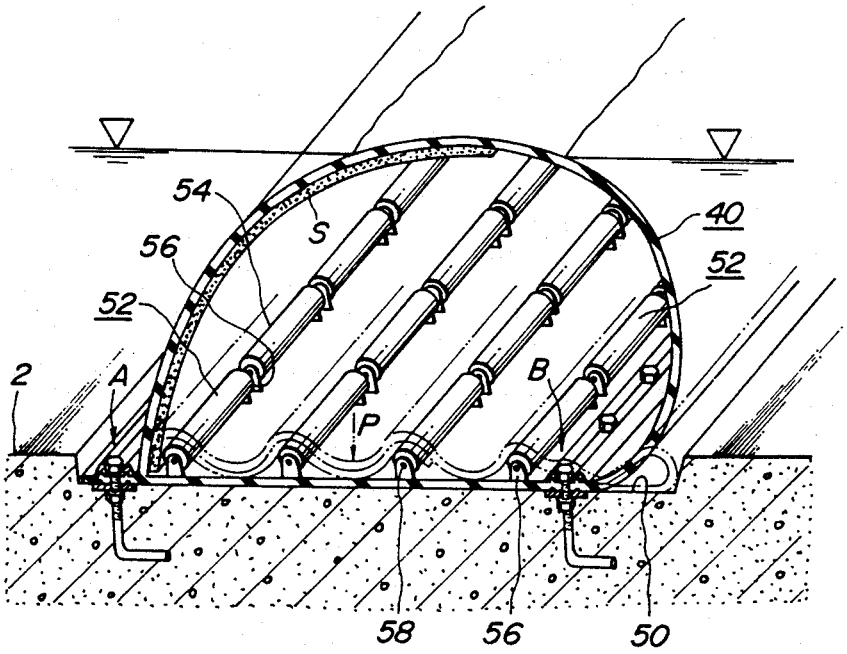

FIG. 10 is an eighth embodiment of the flexible sheet dam, which is different from the embodiment of FIG. 9 in that plural rollers 52 are used instead of the rod members 48 each coated with the lubrication layer. These rollers 52 are arranged on the lower sheet portion between the securing lines A and B at a given interval in a direction parallel to the securing line. The roller 52 is composed of plural roller bodies 54 (each made from a rigid resin or a glass fiber reinforced resin) arranged side by side in a row, each of which is rotatably supported by two support members 56 arranged on the both sides of the roller body 54 and vertically arranged on the lower sheet portion through an axle extending between the support members 56. Moreover, the support member 56 is strongly, bonded to the upper surface of the lower sheet portion through a member of the same material as in the roller body 54.

In the embodiment of FIG. 10, the rollers 52 have the same function as in the rod members 48 of FIG. 9. When the flexible sheet dam 40 is deflated from the inflation state shown by a solid line, complete deflation can easily be attained as shown by a phantom line in FIG. 10.

Figure 11:
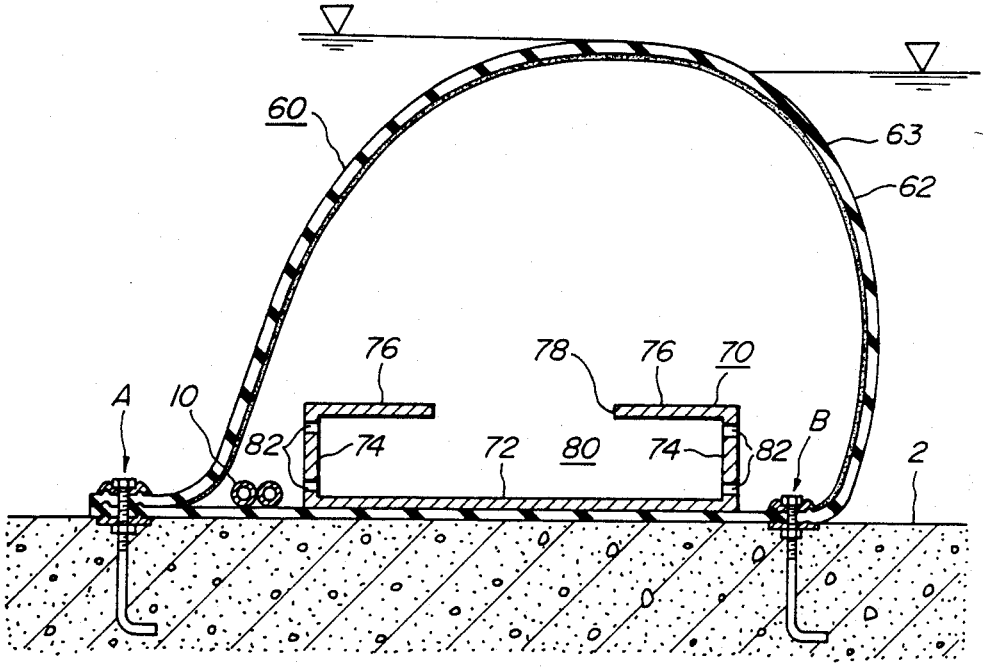
FIG. 11 is a sectional side elevation of a ninth embodiment of the flexible sheet dam according to the invention.
Figure 12:
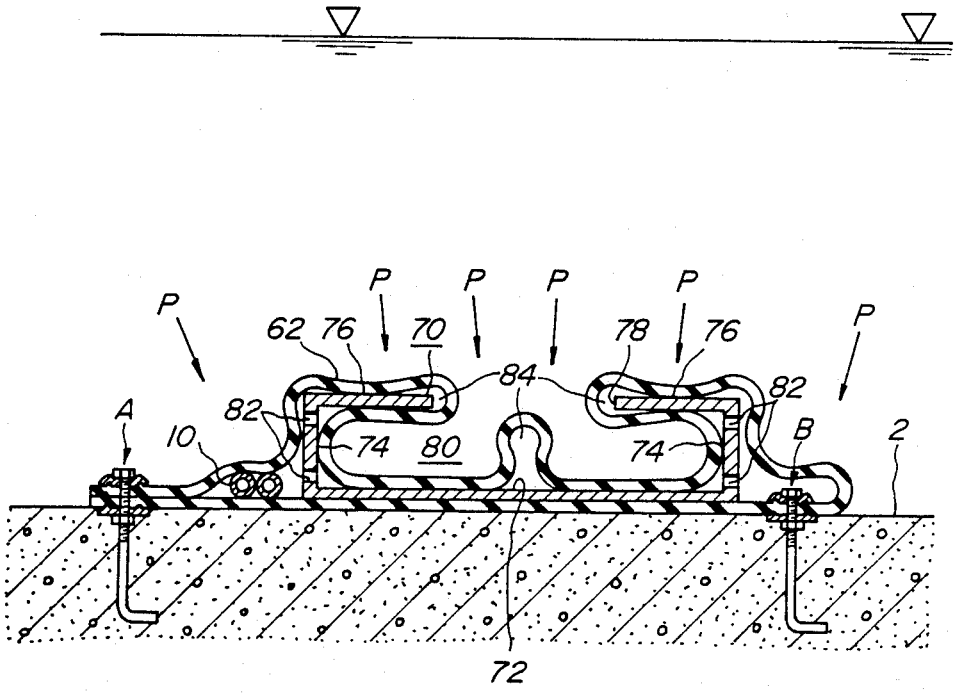
FIG. 12 is a sectional side elevation showing the deflation state of the dam of FIG. 11.

FIG. 11 shows an inflation state of a ninth embodiment of the flexible sheet dam according to the invention, while FIG. 12 shows a deflation state of the flexible sheet dam of FIG. 11. In this embodiment, the flexible sheet dam 60 is laid on the concrete foundation 2 formed in the riverbed. The lower portion of the folded flexible sheet 62 is secured to the concrete foundation 2 along two securing lines A and B separated from each other at a given interval. On the lower portion inside the dam a box-like means 70 is placed for housing a part of the upper portion of the flexible sheet 62 therein during the deflation (hereinafter referred to as a box structure) as a convex portion between the two securing lines A and B.

Figure 13:
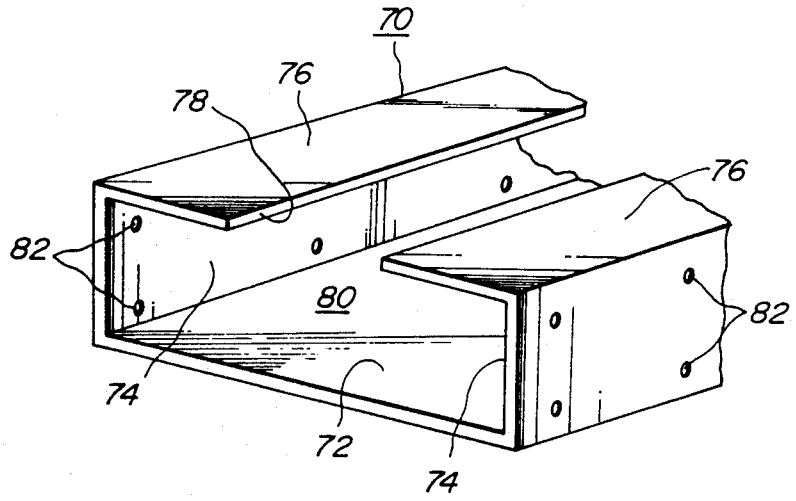
FIG. 13 is a partial perspective view of a member for housing the flexible sheet when the dam is deflated.

The box structure 70 (made from iron or glass fiber reinforced resin) comprises a bottom portion 72 extending across the river, two stand portions 74 standing upward from both side edges of the bottom portion 72 at a certain height, two top portions 76 extending inward from the top of the stand portion 74 in parallel with the bottom plane at a certain distance and an opening 78 defined between the two opposite top portions 76 as shown in FIG. 13. Thus, a housing space 80 for the upper portion of the deflated flexible sheet 62 is defined by the bottom portion 72, two stand portions 74 and two top portions 76.

The box structure 70 is adhered to the lower sheet portion on the concrete foundation 2 through, for example, by an adhesive.

In the box structure 70, of the length is so long as to cause a problem in transportation and construction, the box structure 70 may be constructed by combining plural segments divided in the longitudinal direction thereof with each other. Further, plural box structures 70 may be arranged between the securing lines A and B at a given interval, if necessary.

In the stand portion 74 of the box structure 70 are plural through-holes 82 capable of forcedly discharging air from the housing space to contact the upper portion of the flexible sheet 62 with the surfaces of the bottom portion 72, stand portions 74 and top portions 76 during the deflation of the flexible sheet dam 60 as shown in FIG. 12.

When the flexible sheet dam 60 is deflated from the state shown in FIG. 11 to the state shown in FIG. 12 by forcedly discharging air through the pipes 10, the floating upper portion of the flexible sheet 62 is first pushed from the portion near the securing line A or B toward the box structure 70 by water pressure P to contact with the outer surfaces of the stand portion 74 and top portion 76 of the box structure 70. The remaining portion not contacting the box structure 70 is folded at a substantially middle point. Then the folded parts are contacted with each other by the pushing force of water pressure P and the suction force based on the discharge of the filled air to float in water while leaving a small air space 84 inside the top of the folded contact part. As the discharge of air is further continued, the buoyancy of the floating sheet portion becomes smaller than the weight in water of this portion. Thus, the floating sheet portion falls down into the housing space 80 by the action of water pressure P so as to contact with the inner surfaces of the top and stand portions 76, 74 and the upper surface of the bottom portion 72. Upon the further discharge of air, the folded contact part of the flexible sheet in the housing space 80 is separated and moved toward the top portion, stand portion and bottom portion by forcedly discharging the filled air from the housing space 80 through the through-holes 82 together with water pressure P. Thus, the flexible sheet dam 60 can easily and completely be deflated as shown in FIG. 12.

In order to more effectively discharge air from the inside of the flexible sheet dam 60 during the deflation, plural spacers may be attached to the inner surface of the floating portion of the flexible sheet 62 facing the upstream side at given intervals in the longitudinal direction of the sheet. Furthermore, it is preferred that a lubricant 63 is applied to the inner surface of the floating portion of the flexible sheet 62 in order to smoothly move this portion against the box structure 70 during the deflation of the flexible sheet dam 60.

Figure 14:
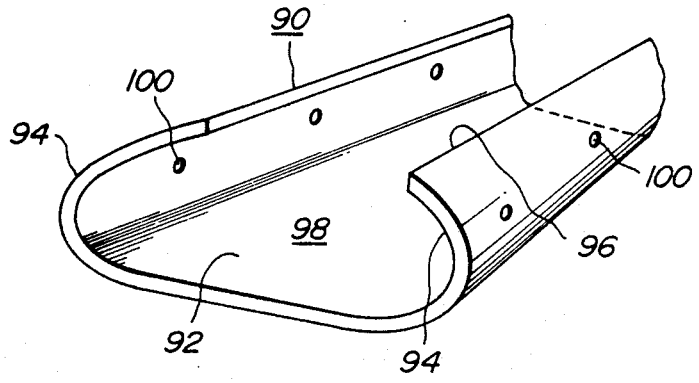
FIG. 14 is a partial perspective view of another member for housing the flexible sheet when the dam is deflated.

FIG. 14 is a modified embodiment of the box structure 70 shown in FIG. 13. That is, the means for housing the floating portion of the flexible sheet during the deflation of the flexible sheet dam as shown in FIG. 14 is an ellipsoid structure 90 (made from iron or glass fiber reinforced resin) having an elliptical shape in section. It comprises a substantially flat bottom portion 92, a pair of upper curved portions 94 extending upward from both sides of the bottom portion 92 at a given ellipticity, an opening portion 96 formed between the opposite edge faces of the upper curved portions 94 to define a housing space 98 gogether with the bottom portion 92 and upper curved portions 94, and plural through-holes 100 formed in each of the upper curved portions 94. It is a matter of course that such an ellipsoid structure 90 has the same function as the box structure 70.

Figure 15:
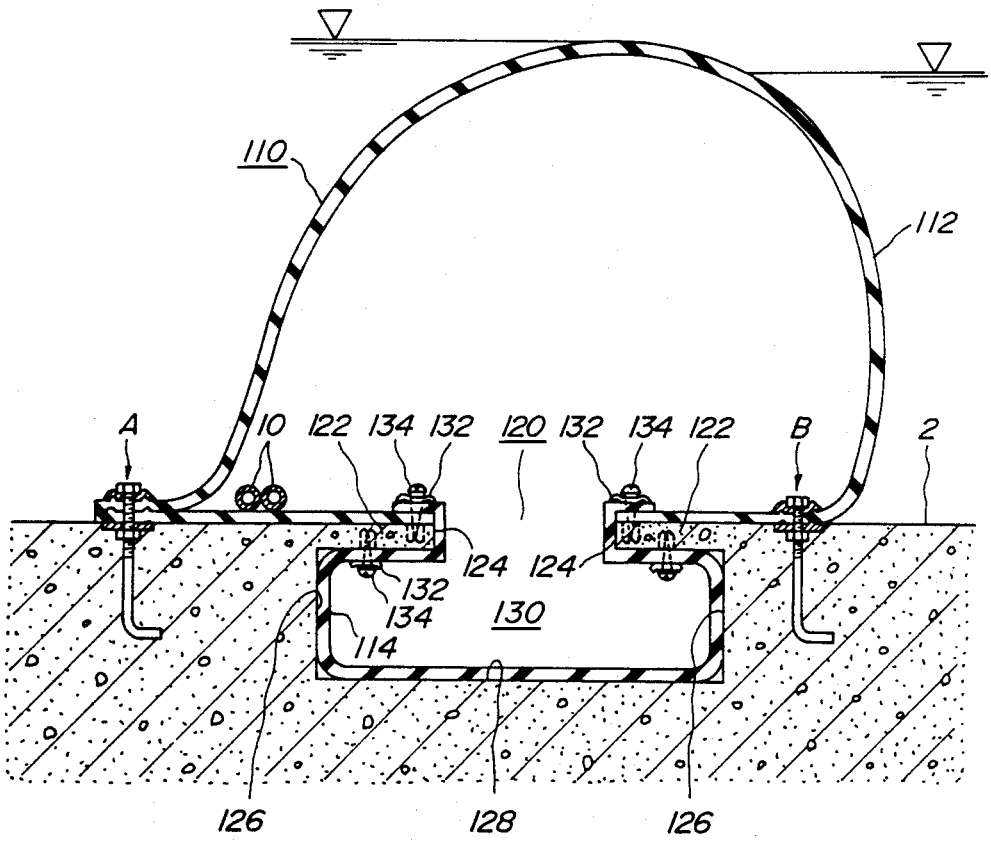
FIG. 15 is a sectional side elevation of a tenth embodiment of the flexible sheet dam according to the invention.
Figure 16:
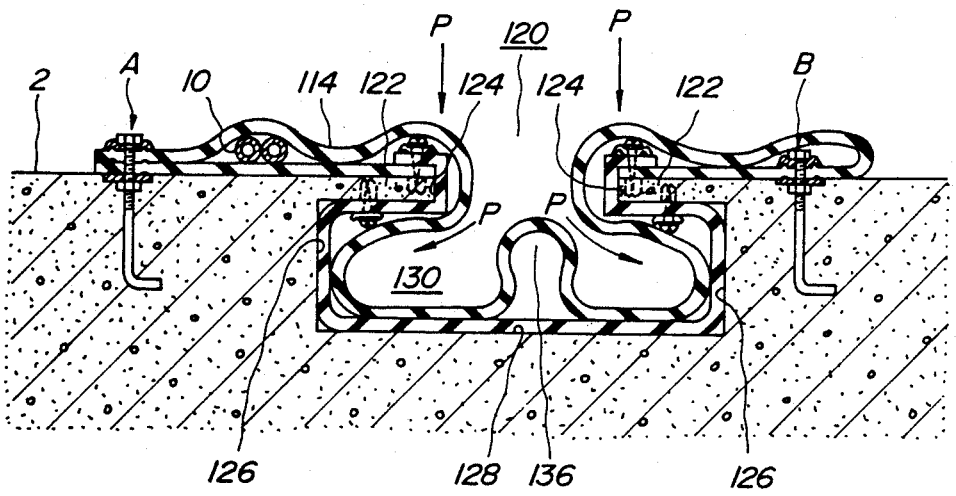
FIG. 16 is a sectional side elevation showing the deflation state of the dam of FIG. 15.

FIG. 15 shows the inflation state of a tenth embodiment of the flexible sheet dam. FIG. 16 shows a deflation state of the embodiment of FIG. 15. In the embodiment shown in FIGS. 15 and 16, when a flexible sheet dam 110 is constructed by securing a lower portion of a flexible sheet 112 to the concrete foundation 2 of the riverbed along two securing lines A and B, a concave portion 120 having a box shape in section and extending in a direction across the river is first formed in the concrete foundation 2 between the securing lines A and B. The concave portion 120 comprises two opposite upper walls 122 each having a given thickness and opening between opening edges 124 at a given intervals. The lower surface of the upper wall 122 extends outward from the opening edge 124. A side wall face 126 extending downward from the end of the upper wall 122 has a given depth as measured from the upper surface of the concrete foundation 2. A bottom wall face 128 is extended between the lower ends of the side wall faces 126 in parallel to the plane of the concrete foundation 2. An internal space defined by the upper walls 122, side wall faces 126 and bottom wall face 128 in the concave portion 120 is used as a housing part 130 for receiving the flexible sheet 112 collapsed into the space during the deflation of the flexible sheet dam 110.

The lower portion of the flexible sheet 112 laid between the securing lines A and B is cut out along the opening edges 124, while another flexible sheet 114 of the same material as in the above lower portion is extended in the concave portion 120 along the bottom wall face 128, side wall faces 126, lower surfaces of the top walls 122. To the lower surface of the top wall 122 is attached to the flexible sheet 114 through a continuous keep member 132 extending lengthwisely thereof and having plural holes at a given interval by means of plural fastening members 134 so as not to hang down from the lower surface of the top wall. Moreover, the free end of the flexible sheet 114 is overlapped with the cut end part of the lower portion of the flexible sheet 112 laid on the upper surface of the top wall 122 and airtightly attached to the top wall 122 by the fastening members 134 through the continuous keep member 132.

When the flexible sheet dam 110 is deflated from the state shown in FIG. 15 to the state shown in FIG. 16 through the discharge of air, the upper floating portion of the flexible sheet 112 is first deflated inward from positions near the securing lines A and B. The substantially middle portion is curvedly deformed by the pushing force of water pressure P applied to the both sides of the sheet and the suction force based on the discharge of air to float in water leaving an air space 136 inside the top part of the deformed portion. As the weight in water of the floating portion becomes larger than the buoyancy of the air space 136, the upper floating portion of the flexible sheet 112 is fallen down into the concave portion 120. As the discharge of air continues the portion of the flexible sheet 112 in the concave portion 120 is moved toward the top wall 122, side wall face 126 and bottom wall face 128 by the synergistic action of the suction force based on the discharge of air and the pushing force of water pressure P. The portion then contacts with the surface of the flexible sheet 114, whereby the upper floating portion of the flexible sheet 112 ca easily and completely be housed in the housing space 130.

In the embodiment of FIGS. 15 and 16, plural spacers forming an air passage therebetween may be attached to the inner surface of the flexible sheet 112 facing the upstream side at a given interval in the longitudinal direction direct thereof in order to more effectively discharge air from the inside of the flexible sheet dam 110 during the deflation. Further, a lubricant 113 may be applied to the inner surface of the floating portion of the flexible sheet 112 for slightly moving the flexible sheet 112 against the flexible sheet 114 in the deflation of the flexible sheet dam 110.

Figure 17:
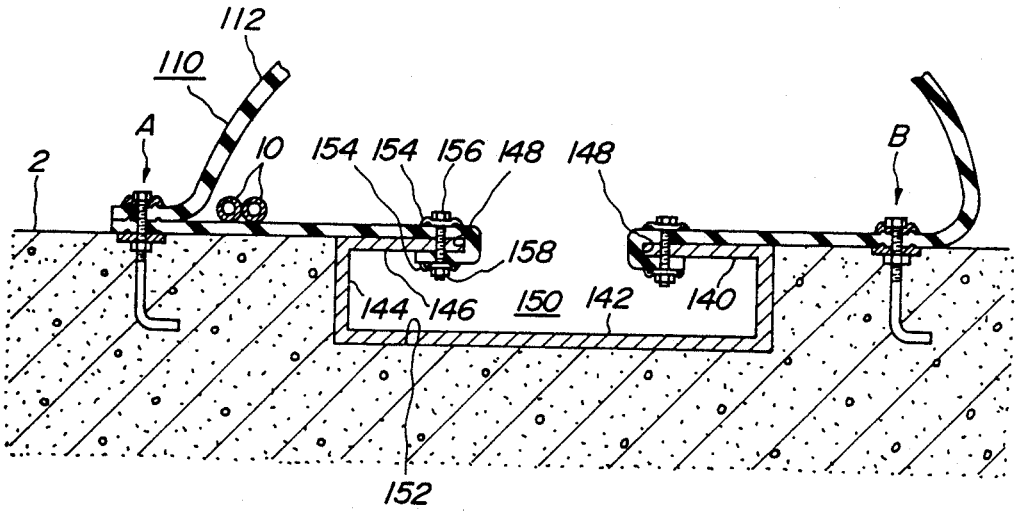
FIG. 17 is a partially sectional side elevation of an eleventh embodiment of the flexible sheet dam according to the invention.

FIG. 17 is a modified embodiment of FIG. 15. That is, a box structure 140 is used instead of the concave portion 120. The box structure 140 has substantially the same construction as in the box structure 70 shown in FIG. 13 and is fitted into a recess 152 formed in the concrete foundation 2 and extending across the river between the two securing lines A and B. Moreover, the box structure 140 comprises a bottom portion 142, two stand portions 144 extending upward from both side edges of the bottom portion 142, and two top portions 146 each extending inward from the top end of the stand portion 144 at a given distance and provided with two opposite opening edges 148, wherein a housing space 150 is defined by the bottom portion 142, two stand portions 144 and two top portions 146.

The lower portion of the flexible sheet 112 laid on the concrete foundation 2 between the securing lines A and B is cut at a position corresponding to a center between the opposite opening edges 148. Then, the free end of the lower cut portion is turned around the opening edge 148 toward the inner surface of the top portion 146, while the lower cut portion is airtightly secured to the top portion 146 through continuous keep members 154 located above and beneath the top portion by means of bolts 156 and nuts 158. In this embodiment, the box structure 140 has the same function as in the concave portion 120 of FIGS. 15 and 16, so that the flexible sheet 112 can easily and completely be housed in the housing space 150 of the box structure 140 in the deflation of the flexible sheet dam 110.

Although the above mentioned embodiments are described with respect to only the arrangement on the riverbed, it is a matter of course that the flexible sheet is secured to both riverbanks and the concave or convex portion is preferably formed on the riverbank in parallel to the securing line. Further, water may be used instead of air for the inflation and deflation of the flexible sheet dam.

As mentioned above, according to the invention, at least one concave and/or convex portion is formed on the riverbed between the two securing lines for the flexible sheet dam, so that the floating portion of the flexible sheet in water can be made as low as possible at the time of deflating the flexible sheet dam. As a result, even when the water level at the downstream side is high, the flowing of water is smooth from the upstream to the downstream, and the sailing of the vessel is not obstructed without trouble. Further, when the means for housing the deflated flexible sheet is formed in the concave and/or convex portion, the complete deflation can be expected.

What is claimed is:

1. A dam comprising: a collapsible, flexible air inflated sheet placed across a flow of water having a predetermined water level at a downstream side, said dam having a length and extending transversely across and secured to a riverbed by two securing means, one of said securing means located on the upstream side of the flow of water and the other of said securing means located at a position separated from the upstream side toward the downstream side at a given interval, wherein a region of said flexible dam extending between said two securing means on the riverbed is a combination of a concave form and a convex form extending in a direction parallel to said securing means over substantially the entire length of said flexible dam.

2. The dam according to claim 1, wherein said concave form is a concave portion formed in the riverbed.

3. The dam according to claim 2, wherein said concave portion is provided with means for housing a portion of a flexible sheet deflated by discharge of air.

4. The dam according to claim 1, wherein said convex form is a convex portion projecting from the riverbed.

5. The dam according to claim 1, wherein said concave form is an elongated member disposed on the riverbed in parallel to said two securing means.

6. The dam according to claim 5, wherein said elongated member is a box.

7. The dam according to claim 5, wherein said concave form is provided with means for housing a portion of a flexible sheet deflated by discharge of air.

8. The dam according to claim 1 wherein said convex form is an elongated rod.

9. The dam according to claim 1, wherein said concave form is provided with means for housing a portion of a flexible sheet deflated by discharge of air.

10. The dam according to claim 1, further comprising means for reducing contact friction between the concave region and the flexible sheet is provided on at least one surface of the convex region and the flexible sheet.

11. The dam according to claim 10, wherein said means is a lubricant layer made from molybdenum disulfide.

12. The dam according to claim 1, further comprising means for reducing contact friction between the convex region and the flexible sheet is provided on at least one surface of the convex region and the flexible sheet.

13. The dam according to claim 12, wherein said means is a lubricant layer made from molybdenum disulfide.

* * * * *